US005353952A

United States Patent [19]

Donche

[11] Patent Number: 5,353,952

[45] Date of Patent: Oct. 11, 1994

[54] ONE-HANDED PARTY AND UTILITY PLATE

[76] Inventor: Mark L. Donche, 5000 Jumper St., Port St. John, Fla. 32927

[21] Appl. No.: 82,447

[22] Filed: Jun. 25, 1993

[51] Int. Cl.[5] ..... B65D 25/30

[52] U.S. Cl. ..... 220/575; 220/574; 220/755; 220/771; 220/737

[58] Field of Search ..... 220/575, 574.1, 574, 220/556, 755, 756, 771, 23.83, 23.86, 636, 735, 737; 294/144, 172; 229/904

[56] References Cited

U.S. PATENT DOCUMENTS

| | | | |
|---|---|---|---|
| D. 305,192 | 12/1989 | van Erkel | D7/1 |
| 1,595,356 | 8/1926 | Moseman | 220/556 |
| 2,042,801 | 6/1936 | Pittman | 65/15 |
| 2,107,381 | 2/1938 | Leppke | 220/575 |
| 2,240,020 | 4/1941 | Raiser | 65/15 |
| 2,625,020 | 1/1953 | Oliver | 220/771 |
| 3,162,344 | 12/1964 | Sabol | 224/48 |
| 3,198,377 | 8/1965 | Buckley | 220/771 |
| 3,315,858 | 4/1967 | Horner | 294/144 |
| 3,504,832 | 4/1970 | Corvetti | 294/144 |
| 3,670,938 | 6/1972 | Brocato | 220/556 |
| 3,941,286 | 3/1976 | Perkinson | 224/48 C |
| 4,461,396 | 7/1984 | Harper | 220/23.83 |
| 4,607,758 | 8/1986 | Stevens | 220/23.83 |
| 4,747,490 | 5/1988 | Smith | 220/735 |
| 4,867,331 | 9/1989 | Task | 220/23.8 |
| 4,901,878 | 2/1990 | Humphries | 220/771 |
| 4,966,297 | 10/1990 | Doty | 220/23.83 |
| 5,165,558 | 11/1992 | Cargile | 220/735 |

FOREIGN PATENT DOCUMENTS

| | | | |
|---|---|---|---|
| 5969 | of 1893 | United Kingdom | 220/575 |

*Primary Examiner*—S. Castellano

*Attorney, Agent, or Firm*—Edward M. Livingston

[57] ABSTRACT

A plate (1) for carrying at the same time a combination of food (29), condiments (30), beverage container (3), knapkin/towelettes (9) or other items having a plurality of different shaped recesses in a top surface (25) and a hand sleeve on a bottom surface (24) into which one hand (12) can be inserted for carrying purposes. The food and condiment (2, 4, 5, 7 & 14) recesses may be arranged symmetrically around a central recess (23) for better balance. The central recess (23) may have a ridge (6) around its circumference to more firmly hold a beverage container (3) and keep it from tipping. A substantially horseshoe-shaped hand sleeve (26) on the bottom surface (24) is designed so that the plate (1) can be carried in one hand (12) by either a left or right-handed person. The horseshoe-shaped sleeve (26) has a flat base attached to the bottom surface (24) at each leg (31*a* & 3*b*) by a pillar (8 &15) which fits between a thumb (18) and first index finger (27), a support (20*a* & 20*b*) on a backside of each leg to contain the fingers of the hand and a wedge (16) in the middle of the back portion to fit between the second and third index finger (19 & 32) for better balance. The bottom surface (24) may be convex shaped to better fit within a palm of the hand and to enable the recesses on the top surface of the plate to be made deeper to hold more food, condiments and other items.

7 Claims, 2 Drawing Sheets

ONE-HANDED PARTY AND UTILITY PLATE

BACKGROUND OF THE INVENTION

This invention relates to serving trays and plates more particularly a combination food, beverage and utensil plate for parties and other social gatherings which can be held easily in only one hand.

Normally, plates made of paper or styrofoam or some type of plastic are used by attendees to hold food. Such plates are often flimsy and require both hands to carry them. Furthermore, such plates do not contain a place to carry beverages and therefore attendees must use both hands to carry both a plate and a beverage. Additionally, utensils have to be carried in the pockets or on the food and then after party-goers have their food and drink, an even more precarious situation arises if there is no seat and the attendees have to stand to eat and drink.

Thus, the need exists for a plate or holder that will help resolve the above problems. Some attempts have been made in the prior art but none like the present invention. For instance, U.S. Pat. No. 3,162,344 by Sabol, issued Dec. 22, 1964, teaches a bottom tray that allows a person to carry it like a catchers mitt. However, Sabol does not have the same structure nor utility as the present invention. U.S. Pat. No. 4,867,331 by Task, issued Sep. 19, 1989, teaches a combination food, drink and utensil holder but again it has a substantially different structure and does not have the utility of the present invention. U.S. Pat. No. 4,461,396 by Harper, issued Jul. 24, 1984, teaches a plate that is designed to hold a glass but again it has an altogether structure than the present invention. U.S. Pat. No. 4,966,297 by Doty, issued Oct. 30, 1990, teaches a stackable food and drink tray that has an entirely different structure than the present invention. U.S. Pat. No. 2,042,801 by Pittman issued Jun. 2, 1936 teaches a dish with a glass holder. U.S. Pat. No. 3,941,286 by Perkins issued Mar. 2, 1976 shows a serving tray with an arm support carried with one hand, however, it has a different structure than the present invention. U.S. Pat. No. 4,607,758 by Stevens, issued Aug. 26, 1986, teaches a two compartment serving tray that carries food in one compartment and holds a glass in the other but still has a different structure than the present invention. U.S. Pat. No. 2,240,020 by Raiser, issued Apr. 29, 1941, teaches a plate and hors d'oeuvres tray having a cup holder in the center. U.S. Des. Pat. No. 305,192 by Van Erkel, issued Dec. 26, 1989, teaches a party plate with separate compartments to hold food and drink having some features that the present invention, but is still substantially different in structure and other respects from the present invention.

Contrary to the patented inventions in the prior art, the present invention provides a party or utility plate that can be carried in one hand which can hold simultaneously food, beverage cup, utensils, knapkin or towelette having a preferably convex-shaped bottom surface which fits comfortably into one hand and has a hand sleeve mounted to the bottom surface by pillars and supports. Thus, the plate, even when fully loaded can be balanced so that spillage will be lessened and from which one can eat even while standing.

SUMMARY OF THE INVENTION

The primary object of the present invention is to provide a plate that will carry in combination food, a beverage cup, utensils and even knapkins or towelette.

An ancillary object of the present invention is to provide such a plate that requires only one hand to carry and hold it while eating.

Another object of the present invention is to provide such a plate that balances easily so that it makes eating possible while standing and avoids spillage.

A further object of the present invention is to provide such a plate that is stackable for easy packing and storage.

An even further object of the present invention is to provide such a plate that is useable by both left or right-handed persons.

The present invention fulfills the above and other objects by providing a plate having a rigid platform with a top surface having a plurality of recesses for holding various types of food, condiments or other articles. The top surface of the plate also contains a central recess for holding a circular beverage cup, a rectangular recess for holding a knapkin or towelette and means for retaining elongated items such as utensils or pencils. The recesses are preferably arranged in a symmetrical fashion around the central recess for balancing purposes. That plate also has a bottom surface which is preferably convex shaped to make it easier to fit into the palm of a hand. The bottom surface may contain a substantially horseshoe-shaped sleeve for insertion of one hand. The sleeve has a flat base which may be mounted on two pillars at each of its legs extending from the bottom surface of the plate, each pillar to fit between a thumb and an index finger. The sleeve may also have other supports on its back side and a wedge in the middle of the back side for fitting between the second and third index fingers. The hand sleeve provides a significant balancing feature to the plate. Other optional features include a ridge around the circumference of the central recess to provide better holding of the beverage cups to keep them from tipping. Finally, the means for retaining the elongated items such as utensils or a pencil may consist of a pair of ridges spaced apart from each other to hold opposite ends of the elongated items.

These and other objects and advantages of the present invention may become even more apparent when a preferred embodiment of the invention is described in conjunction with the accompanying drawings.

BRIEF DESCRIPTION OF THE DRAWINGS

This drawing figures used to illustrate the preferred embodiment are as follows.

DESCRIPTION OF THE PREFERRED EMBODIMENTS

Figure 1:
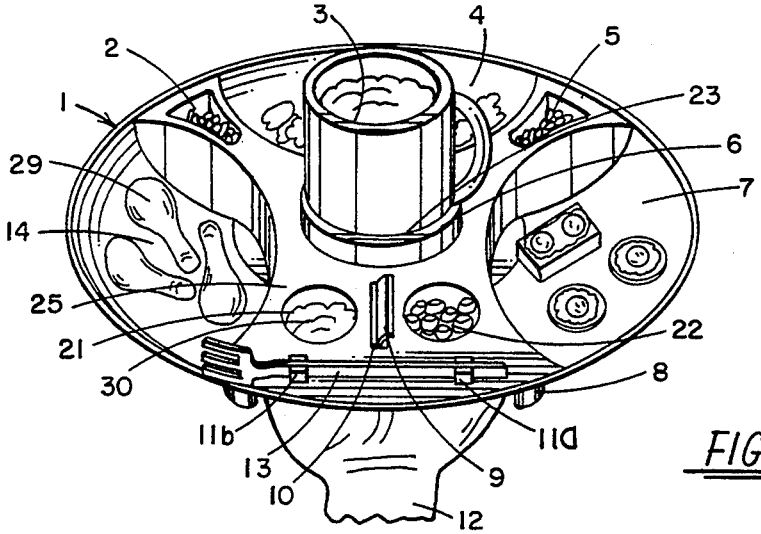
FIG. 1 is a perspective view showing the invention used as a party plate holding food, condiments, utensil and knapkin/towelette.

The drawings depict the invention as it might be used for a party plate. In FIG. 1 the plate or invention 1 is shown having an essentially rigid planar top surface 25 which contains a plurality of recesses to hold food and condiments. As shown, these recesses include two large recesses 7 and 14 on diametrically opposite sides of the plate 1, a third large recess 4 between and back from the large recesses 7 and 14, small recesses 2 and 5 and small recesses 21 and 22. The top surface 25 also includes a central recess 23 for holding an object such as a beverage cup 23. The central recess 23 may also contain a ridge 6 around its circumference in order to better hold a cup 23 and keep it from tipping when full. Other features on the top surface 25 include a rectangular recess or slot 10 for holding a knapkin or towelette 9 and means for holding an elongated object such as a fork 13, which means may consist of two pairs of ridges 11*a* and 11*b* spaced apart from each other to hold opposite ends of the utensils.

Figure 2:
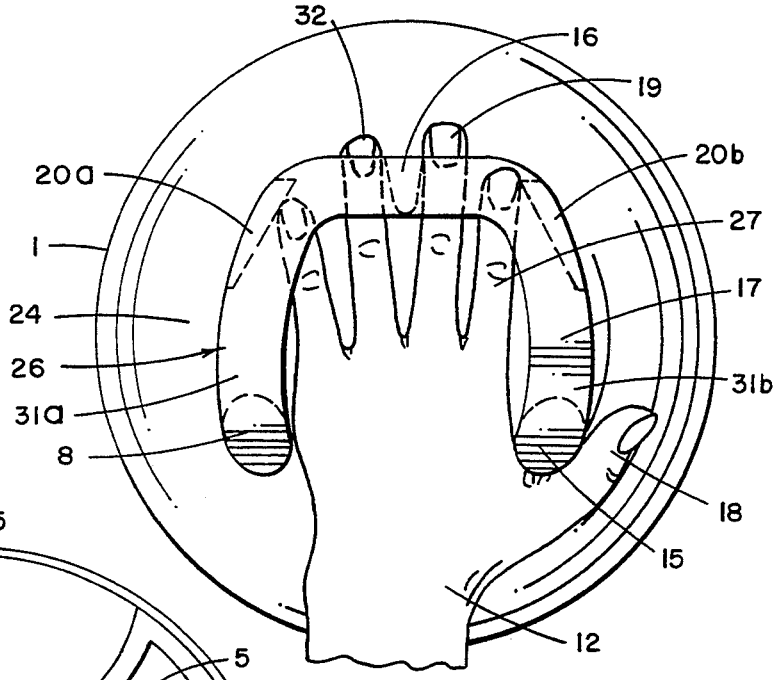
FIG. 2 is a bottom view showing the hand sleeve being held by one hand.

As designed, the plate can be held with one hand 12 by use of the hand sleeve 26 illustrated in FIG. 2. The hand sleeve 26 is mounted to the bottom surface 24 of the plate 1 so that one hand 12 can be placed into it to hold the plate 1. The hand sleeve 26 consists of a flat bottom base 17 mounted to the bottom surface 24 of the plate 1 by several pillars or supports 8, 15, 20*a*, 20*b* and 16. The pillars 8 and 15 are mounted at the end of each leg 31*a* & 31*b* of the substantially horseshoe-shaped sleeve 26 so that when the hand 12 is inserted one of the pillars, depending on whether the person is left-handed or right-handed, fits between the thumb 18 and the first index finger 27. The two supports 20*a* and 20*b* are mounted on each side near the back of each leg 31*a* and 31*b* between the base 17 and the bottom surface 24. Finally, a wedge-shaped support 16 is mounted at the back in the center of the base 17 so that it fits between the second and third index fingers 19 and 32, respectively. As described the design of this horseshoe-shaped hand sleeve enables the plate to be carried by either a left or right-handed person and provides the necessary balancing points to keep the plate level and avoid spillage of food and other items contained therein.

Figure 3:
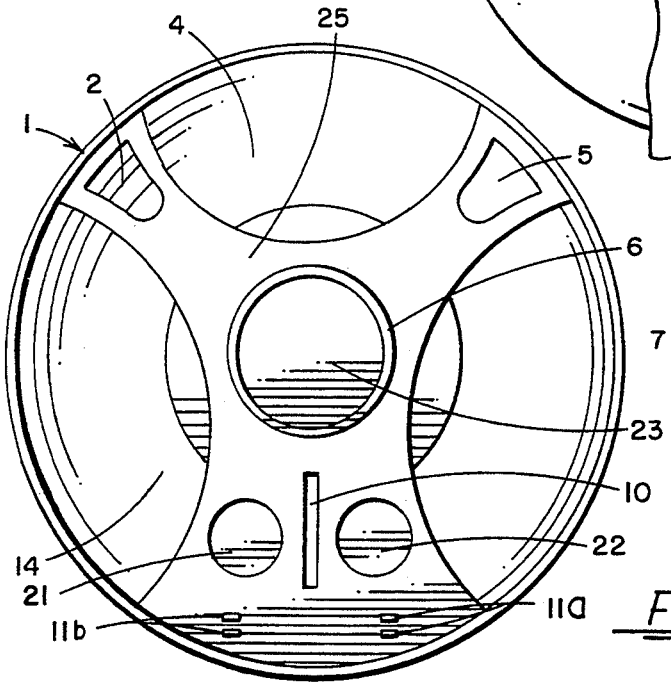
FIG. 3 is a top view of the plate by itself.

FIG. 3 shows a plate by itself and illustrates the same features already described in FIG. 1. Thus, no further elaboration is necessary.

Figure 4:
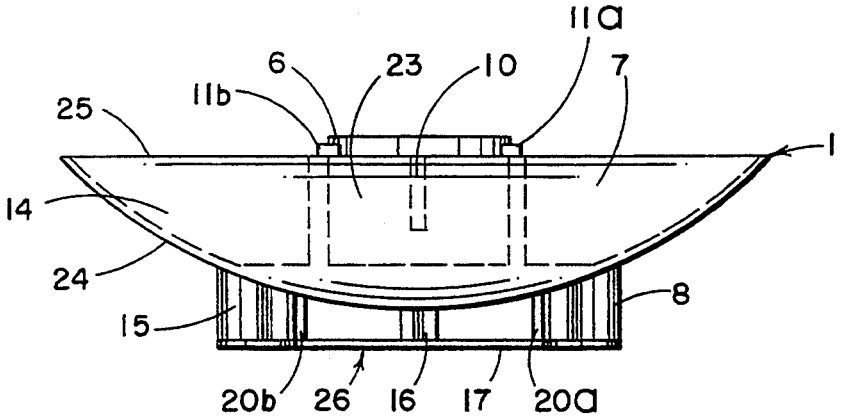
FIG. 4 is a front side view of the plate by itself.

FIG. 4 shows the plate 1 with a convex bottom surface 24 which allows the plate to better fit within the palm of a hand. A convex bottom surface 24 would also allow the top surface 25 to be deeper and to hold more food than would be possible with a flat bottomed surface plate. Also, the central recess 23 could be deeper to hold a larger beverage container. The recess or slot 10 for a knapkin or towelette 9 is also shown. The hand sleeve 26 would take the same form having a flat base 17 mounted on pillars and supports 15, 16, 18, 20*a* and 20*b*.

Figure 5:
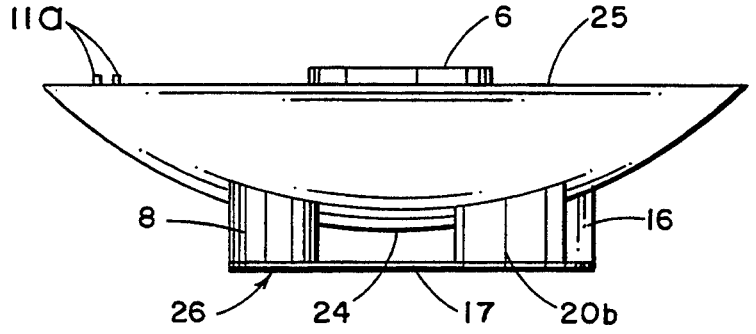
FIG. 5 is a side view of the plate by itself.

As illustrated in FIG. 5 the side view of the invention shows the major features of the invention, particularly the hand sleeve 26 and its flat bottom base 17. The construction of the hand sleeve 26 is designed such that the plate 1 may be stacked with other plates for easy storage and shipping by turning each alternately stacked plate so that the front portion or horseshoe containing the wedge 16 fits between the pillars 8 and 15 and the legs of the horseshoe. In this manner the plates can be stacked and stored more compactly firmly and securely in place.

Figure 6:
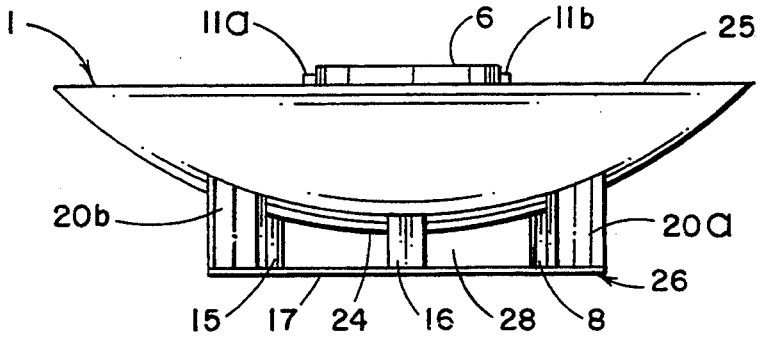
FIG. 6 is a backside view of the plate.

FIG. 6 shows the plate 1 as it would appear looking from the back showing the hand sleeve 26 with its flat bottom base 17 attached to the bottom surface 24 of the plate 1 by backside supports 20*a* and 20*b*, the wedge 16 and front pillars 8 and 15. The bottom base 17 is attached by the latter supports to the bottom surface 24 so that sufficient space 28 remains between the bottom surface 24 and the base 17 to allow insertion of almost any size of hand.

The entire invention may be made entirely from plastic, styrofoam or other rigid material. In addition to being used as a party plate for carrying food, beverage and other items, the invention may also be used for prepackaged food, such as rations for the military, to hold items used in medical labs and even for miscellaneous uses such as by artists to hold various colors of paint and other items.

Although, only a preferred embodiment of a new and non-obvious plate having numerous advantages over the prior art has been described, all foreseeable variations and modifications within the scope or equivalents of the claims are covered by this invention.

Having thus described my invention, I claim the following:

1. A plate for carrying a variety of food, a beverage, utensils, napkins, towelettes and other items comprising:

a rigid platform having a bottom surface and a top surface, said top surface having a plurality of recesses therein for holding various types of food, condiments and other objects; and a central recess in the top surface for holding a beverage container; and wherein the bottom surface contains a sleeve, said sleeve comprising a substantially horseshoe-shaped flat base attached to the bottom surface of the plate a sufficient distance from said bottom surface to allow insertion of one hand, said base having two legs and a cross member, the legs being attached at a free end to the bottom surface of the plate by two pillars extending perpendicular from the base, only one of said pillars fits between a thumb and a first index finger of the one hand, and the cross member being attached to the bottom surface by supports and a wedge extending perpendicular to the base and which spaces the base from the bottom surface.

2. A plate for carrying a variety of food, a beverage, utensils, napkins, towelettes and other items comprising:

a rigid platform having a bottom surface and a top surface, said top surface having a plurality of recesses therein for holding various types of food, condiments and other objects, wherein the bottom surface is substantially convex-shaped to conform to a palm of a hand;

a central recess in the top surface for holding a beverage container;

a rectangular recess for holding a napkin and towelette;

means for retaining elongated items, utensils and pencils, said means consisting of two pairs of ridges extending upward from the top surface, each of said pairs of ridges being spaced apart from each other a sufficient distance so that it holds the elongated item near each of its opposite ends; and wherein the bottom surface contains a sleeve, said sleeve comprising a substantially horseshoe-shaped flat base attached to the bottom surface of the plate a sufficient distance from said bottom surface to allow insertion of one hand, said base having two legs and a cross member, the legs being attached at a free end to the bottom surface of the plate by two pillars extending perpendicular from the base, only one of said pillars fits between a thumb and a first index finger of the one hand, and the cross member being attached to the bottom surface by supports and a wedge extending perpendicular to the base and which spaces the base from the bottom surface.

3. The plate of claim 2 wherein the plurality of recesses on the top surface are arranged in a symmetrical fashion around the central recess for improved balancing of the plate.

4. The plate of claim 1 wherein the central recess has an elevated ridge around the circumference to better hold a beverage container.

5. The plate of claim 3 wherein the central recess has an elevated ridge around the circumference to better hold a beverage container.

6. The plate of claim 1 further comprising means for retaining elongated items, said means consisting of two pairs of ridges extending upward from the top surface, each of said pairs of ridges being spaced apart from each other a sufficient distance so that it holds the elongated item near each of its opposite ends.

7. The plate of claim 1 further comprising a rectangular recess for holding a napkin and towelette.

* * * * *